US010151130B2

(12) United States Patent
Wang et al.

(10) Patent No.: US 10,151,130 B2
(45) Date of Patent: Dec. 11, 2018

(54) TRIGGER AND DOOR TRACK UNIT WITH THE SAME

(71) Applicant: Weider Metal Inc., New Taipei (TW)

(72) Inventors: Grace Show-Yin Wang, New Taipei (TW); Jennifer Wu, New Taipei (TW); Andy Wu, New Taipei (TW); Jacqueline Wu, New Taipei (TW)

(73) Assignee: Weider Metal Inc., New Taipei (TW)

( * ) Notice: Subject to any disclaimer, the term of this patent is extended or adjusted under 35 U.S.C. 154(b) by 0 days.

(21) Appl. No.: 15/657,383

(22) Filed: Jul. 24, 2017

(65) Prior Publication Data

US 2018/0283074 A1 Oct. 4, 2018

(30) Foreign Application Priority Data

Mar. 30, 2017 (TW) ..... 106204509 U

(51) Int. Cl.
*E05F 5/00* (2017.01)
*E05F 1/16* (2006.01)

(52) U.S. Cl.
CPC ..... *E05F 5/003* (2013.01); *E05F 1/16* (2013.01); *E05Y 2201/412* (2013.01); *E05Y 2800/24* (2013.01); *E05Y 2800/422* (2013.01)

(58) Field of Classification Search
CPC ..... E05F 5/003; E05F 1/16; E05Y 2800/422; E05Y 2201/412; E05Y 2800/24; Y10T 16/593; Y10T 16/56
USPC ..... 16/96 R, 49; 52/204.51
See application file for complete search history.

(56) References Cited

U.S. PATENT DOCUMENTS 5,960,849 A * 10/1999 Delaney ..... B66D 1/50 160/188
8,151,413 B2 * 4/2012 Iwaki ..... E05F 11/08 16/49
9,121,210 B2 * 9/2015 Rioja Calvo ..... E05F 1/16
9,945,167 B2 * 4/2018 Svara ..... E05F 5/003
2011/0203075 A1 * 8/2011 Iwaki ..... E05F 11/08 16/49
2014/0026357 A1 * 1/2014 Zimmer ..... E05F 1/16 16/72

(Continued)

FOREIGN PATENT DOCUMENTS

JP 2016176331 A * 10/2016 ..... E05F 1/16
TW I558898 B 11/2016

*Primary Examiner* — Brent W Herring
(74) *Attorney, Agent, or Firm* — Alan D. Kamrath; Kamrath IP Lawfirm, P.A.

(57) ABSTRACT

A trigger has an upper board and a lower board. The lower board is detachably mounted on the upper board and has an open slot and an elongate board. The open slot is formed through an end of the lower board, and the elongate board is formed on the middle of the open slot and extends to the end of the lower board. The free end of the elongate board is bent perpendicularly to the elongate board. The door track with the trigger includes two installation boards, and two ribs are formed on the two installation boards respectively and extend toward each other. The upper board is mounted on the top surfaces of the ribs of the installation boards, and the lower board is mounted on the bottom surfaces of the ribs. When the sliding door collides with the trigger, the trigger can be deformed and prevents the slider of the sliding door from being restricted by the trigger.

10 Claims, 16 Drawing Sheets

(56) References Cited

U.S. PATENT DOCUMENTS

| | | | | |
|---|---|---|---|---|
| 2014/0109343 | A1* | 4/2014 | Chang | E05F 5/003 16/49 |
| 2016/0369547 | A1* | 12/2016 | Sato | E05F 1/16 |
| 2017/0130501 | A1* | 5/2017 | Svara | E05F 5/003 |
| 2018/0016832 | A1* | 1/2018 | Rodriguez Rodriguez | E05D 15/06 |

* cited by examiner

TRIGGER AND DOOR TRACK UNIT WITH THE SAME

BACKGROUND OF THE INVENTION

1. Field of the Invention

The present invention relates to a sliding door trigger, especially to a trigger that starts the soft close of the sliding door, as well as the door track unit for the installation of the trigger.

2. Description of the Prior Arts

With reference to FIGS. 14 to 16, in the mechanical structure of the conventional sliding door trigger, as disclosed by Taiwan patent No. 1558898, a trigger 70 has an upper board 71 and a lower board 72, an engaging block 711 extends downwardly from an end of the upper board 71, and the lower board 72 is mounted on the upper board 71 through multiple fixing screws 73.

A door track 80 for the installation of the sliding door has two upper fixing units 81 formed respectively on two opposite sides of the inner surface of the door track 80.

Two clipping ribs 82 are each respectively formed under and apart from the two upper fixing units 81, thereby forming two upper fixing slots 83 each between a respective pair of the upper fixing unit 81 and the clipping rib 82.

Two lower stopping ribs 84 are each respectively formed under and apart from the two clipping boards 82. Within each pair of the clipping board 82 and the lower stopping rib 84, one lower fixing slot 85 is formed between the clipping board 82 and the lower stopping rib 84. Therefore, when the trigger 70 is mounted on the door track unit 80, the upper board 71 is mounted in the upper fixing slot 83, the lower board 72 is mounted in the lower fixing slot 85, and the engaging block 711 is mounted toward the bottom opening of the door track unit 80.

A soft close buffer 60 is mounted on the top of the sliding door (not shown in the figures) to slow down the sliding speed of the sliding door, preventing the collision between the sliding door and the trigger 70; furthermore, the soft close buffer 60 is connected with the sliding door through a hanger 66, and a sliding wheel 64 is mounted in the door track unit 80; when implemented, after a flange 632 of a slider 63 of the soft close buffer 60 has abutted upon the engaging block 711, a pressure cylinder 61 mounted in the door track unit 80 is triggered to slow down the sliding speed of the sliding door.

However, if the user pushes or pulls the sliding door excessively, forcing the flange 632 of the slider 63 to pass through the engaging block 711 of the trigger 70, the engaging block 711 will be stuck by the flange 632 because the downwardly extending length of the engaging block 711 and the height of the flange 632 are on the same level of height, making the flange 632 unable to be pulled back to the former position; furthermore, after being collided, the engaging block 711 will be permanently upturned, which also makes it impossible for the sliding door to move in the correct path.

Therefore, when a user tries to move the sliding door again after the collision, the moving path of the two sliders 63 of the soft close buffer 60 will be constrained by the engaging block 711 of the trigger 70, which means that the user might not be able to use the sliding door normally unless the sliding door is repaired; besides, during the repair, it is necessary to disassemble the whole sliding door to replace or remount the trigger 70.

Meanwhile, because of the structure of the lower stopping ribs 84 of the door track unit 80, when replacing the trigger 70, the user needs to remove the upper board 71 and the lower board 72 from one, of the both ends of the door track unit 80 after removing the fixing bolts 73, making the replacing procedure inconvenient.

To overcome the shortcomings, the present invention provides a trigger and a door track unit for the trigger to mitigate or obviate the aforementioned problems.

SUMMARY OF THE INVENTION

The main objective of the present invention is to provide a trigger and a door track unit with the same that overcomes the shortcomings of the conventional art, including, for example, the stuck issue between the trigger and the slider that causes the sliding door incapable of moving, the structure of the lower stopping ribs that makes the replacing and repairing procedure inconvenient, and so forth.

By applying the technical means of the present invention, the trigger is allowed to operate normally after being impacted by excessive force and the structure of the door track unit is improved, making the replacement and remounting procedure more convenient.

The trigger has an upper board and a lower board. The upper board is an elongate block. The lower board is an elongate block detachably mounted on the upper board. The lower board comprises an open slot and an elongate board. The open slot is formed in an end of the lower board in a longitudinal direction of the lower board. The elongate board is formed on a middle of the open slot and extends to the end of the lower board, wherein a free end of the elongate board is bent downwardly and perpendicularly to the elongate board. At the end of the lower board, where the open slot and the elongate board are formed, the open slot and the elongate board both horizontally extend over an end of the upper board.

The door track unit comprises the trigger and a door track. The door track is elongate and hollow and has a bottom opening and two installation boards. The bottom opening is formed on the bottom surface of the door track in the longitudinal direction of the trigger. The two installation boards are formed on and protrude from the inner surface of a top wall of the door track toward the bottom opening, wherein the two installation boards are disposed apart from each other. Two ribs are formed on two side surfaces of the two installation boards respectively. The two ribs extend toward each other. The upper board of the trigger is mounted on two top surfaces of the two ribs of the two installation boards, and the lower board is mounted under two bottom surfaces of the two ribs of the two installation boards.

Given the forgoing structure of the trigger and the door track with the same trigger, the open slot of the lower board increases the deformable range on the both sides of the elongate board and also creates a space on the top of the elongate board, which allows the elongate board to deform instantaneously and upwardly. Therefore, when the sliding speed of the sliding door is too fast, forcing the slider of the soft close to move through the trigger, the trigger will not be stuck within the two sliders because the elongate board deforms upwardly and away from the two flanges of the two sliders. Therefore, after the impact from the soft close, the trigger still functions normally.

Moreover, in the present invention, there are only two ribs extending from the two installation boards, which are formed within the upper board and the lower board, so when the elongate board is deformed and needs to be replaced, the user may directly replace the lower board from the bottom opening of the door track, which improves the convenience of the replacing procedure of the present invention.

In addition, the noise reduction block wrapped around the free end of the elongate board of the lower board absorbs the vibration caused by the collision between the elongate board and the slider and also reduces the noise produced by the vibration of the glass sliding door.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
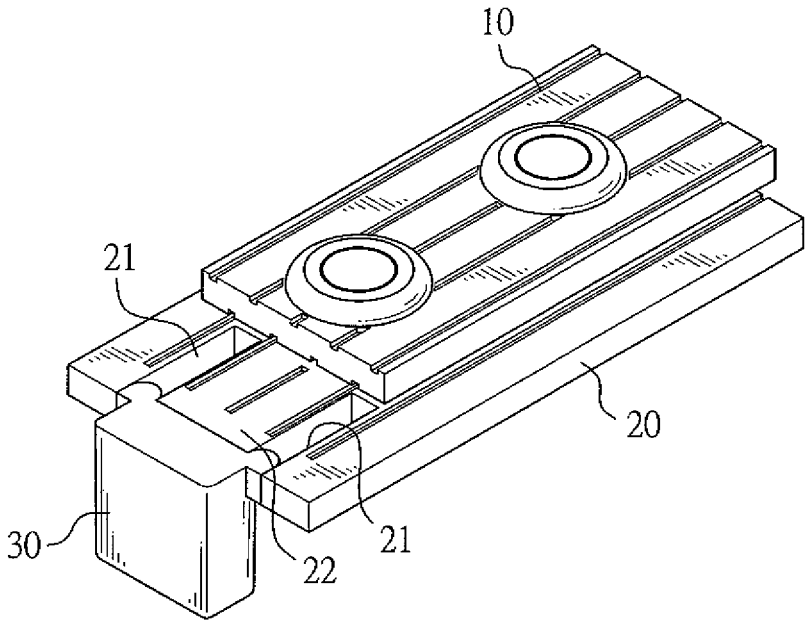
FIG. 1 is a perspective view of a trigger in accordance with the present invention.
Figure 2:
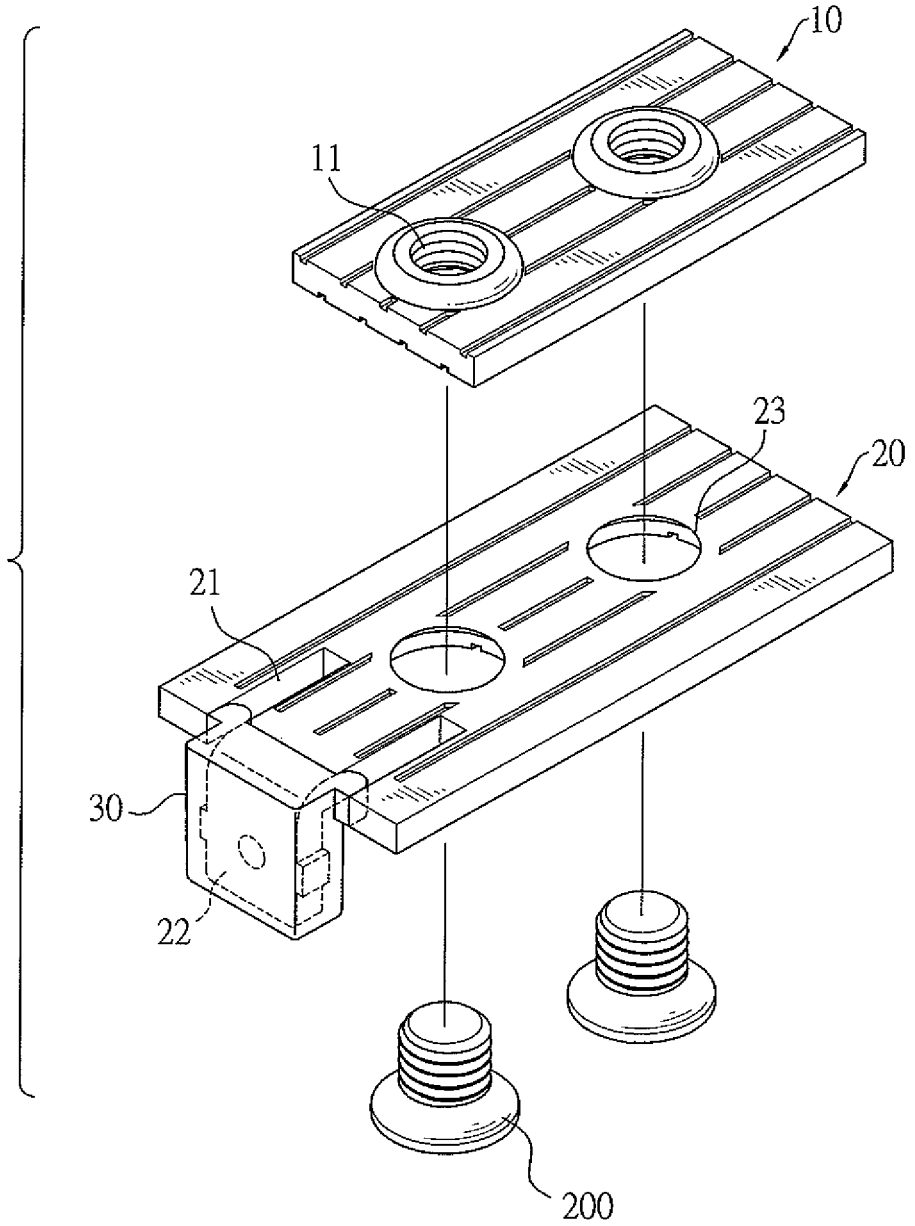
FIG. 2 is an exploded perspective view of the trigger in FIG. 1.

With reference to FIG. 1 and FIG. 2, a trigger in accordance with the present invention comprises an upper board 10, a lower board 20 and a noise reduction block 30.

With reference to FIG. 1 and FIG. 2, the upper board 10 is an elongate block.

The lower board 20 is an elongate block comprising an open slot 21 and an elongate board 22.

The open slot 21 is formed in an end of the lower board 20 in a longitudinal direction of the lower board 20.

The elongate board 22 is formed on a middle of the open slot 21 and extends to the end of the lower board 20. A free end of the elongate board 22 is bent downwardly and perpendicularly, relative to the extending direction of the elongate board 22.

The lower board 20 is detachably amounted on the upper board 10, the open slot 21 and the elongate board 22 both horizontally extend over the end of the upper board 10.

In an embodiment disclosed by the figures of the present invention, the upper board 10 comprises at least one connecting hole 11 formed through the upper board 10. The lower board 20 further comprises at least one through hole 23 and at least one connecting element 200. The at least one through hole 23 is formed through the lower board 20, and the at least one connecting element 200 is mounted through the at least one through hole 23 and screwed with the at least one connecting hole 11. More precisely, the at least one connecting hole 11 is each a screw hole, and the at least one connecting element 200 is each a screw.

The noise reduction block 30 is wrapped around the elongate board 22 from the free end of the elongate board 22 to the perpendicularly bent part of the elongate board 22 by injection molding.

Figure 3:
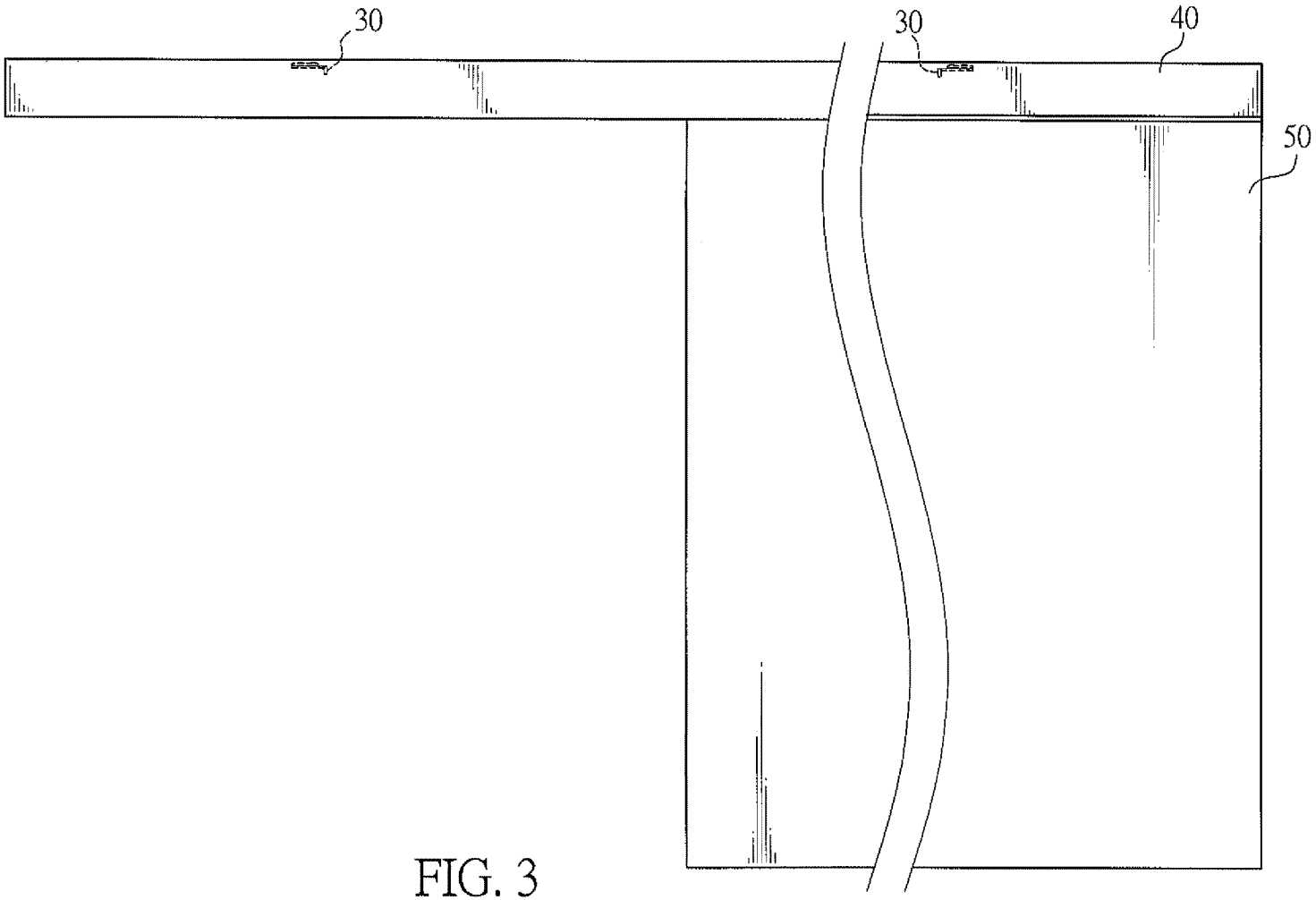
FIG. 3 is a front view of the trigger and the door track unit when installed.
Figure 4:
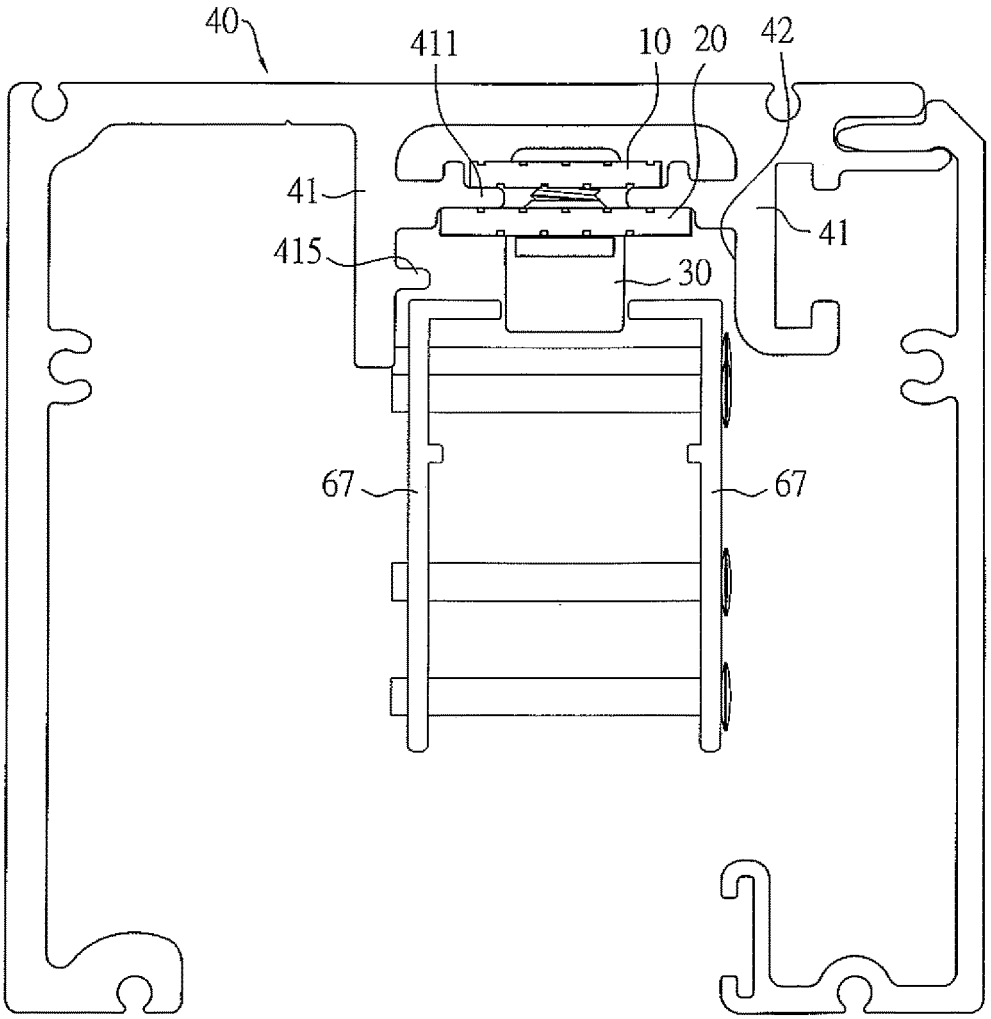
FIG. 4 is a side view of the door track unit in FIG. 3.

With reference to FIG. 3 and FIG. 4, the door track unit for the installation of the trigger comprises a door track 40 and at least one trigger as mentioned above.

The door track 40 is elongate and hollow and has a bottom opening formed in the longitudinal direction of the trigger. Two installation boards 41, as a pair, protrude from the inner surface of the top wall of the door track 40 to the bottom opening, wherein the two installation boards 41 are disposed apart from each other. Furthermore, a limiting rib 415 is formed on the inner surface of one of the two installation boards 41. The limiting rib 415 is formed along the longitudinal direction of the door track 40.

Figure 5:
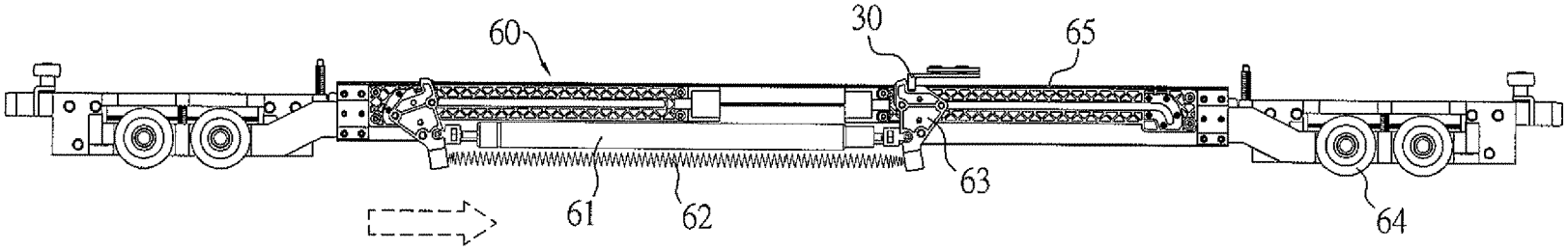
FIG. 5 is a front view of the trigger with the soft close buffer.

With reference to FIG. 4 and FIG. 5, the limiting rib 415 is used to abut upon a housing 67 of a soft close buffer 60, which prevents the soft close buffer 60 from vibrating in the door track 40.

Two ribs 411 are formed on two side surfaces of the two installation boards 41 respectively. The two ribs 411 extend toward each other.

The upper board 10 of the trigger is mounted on two top surfaces of the two ribs 411 of the two installation boards 41, and the lower board 20 is mounted on two bottom surfaces of the two ribs 411 of the two installation boards 41.

With reference to FIG. 4, an installation space 42 is formed under the lower board 20, wherein the width of the installation space is greater than a width of the lower board 20.

Figure 6:
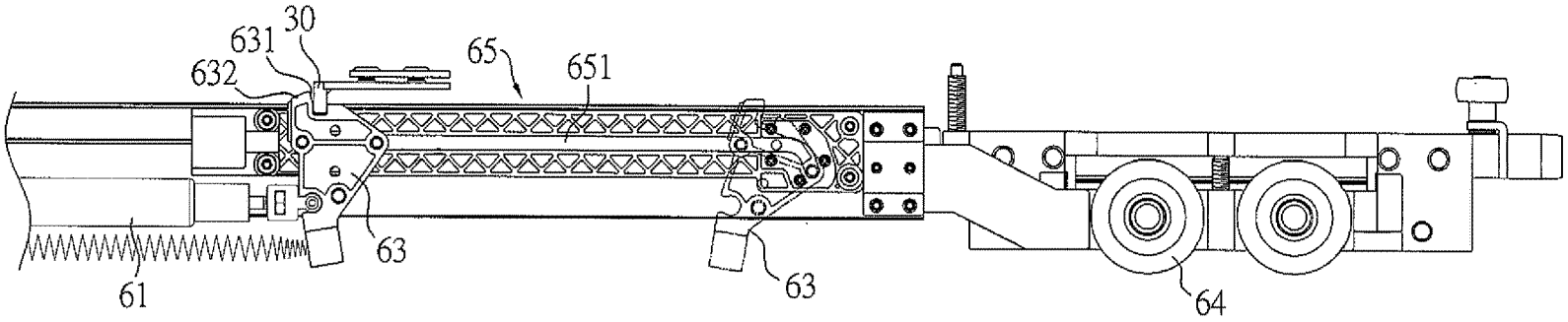
FIG. 6 is a partially enlarged front view of FIG. 5.
Figure 9:
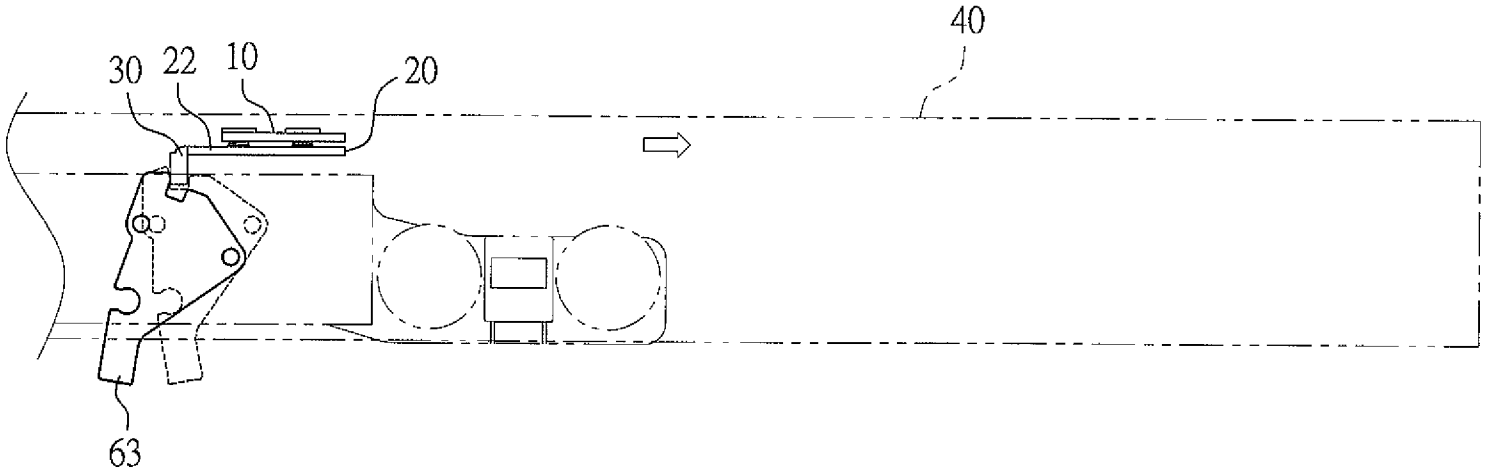
FIG. 9 is a partially enlarged front view of the trigger and the slider of the present invention.
Figure 10:
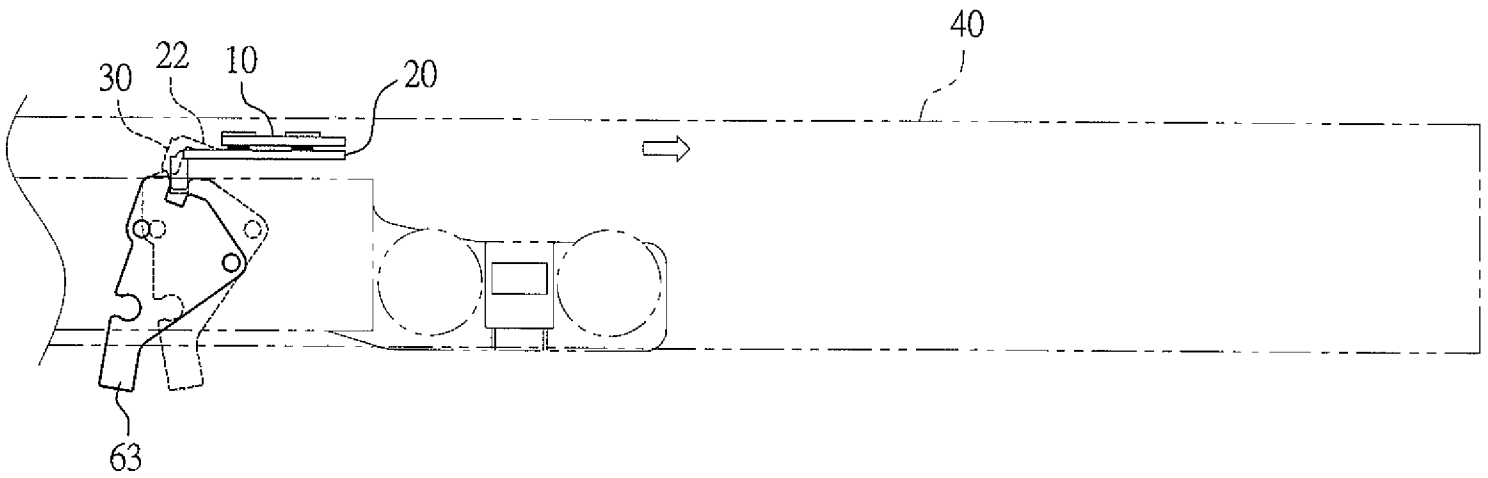
FIG. 10 is a partially enlarged front view of the deformed trigger of the present invention.

With reference to FIG. 3, FIG. 5 and FIG. 6, after the trigger of the present invention is mounted on the door track 40, when the sliding door 50 moves toward the trigger, the soft close buffer 60 on the top of the sliding door 50 slides inside the door track 40. Therefore, the top of the slider 63 will be triggered by the noise reduction block 30 of the trigger and thereby the pressure cylinder 61 of the soft close buffer 60 is triggered, slowing down the moving speed of the sliding door 50. During the process, the slider 63 will slide along a rail 651 of a rail board 65 of the soft close buffer 60, from one side of the rail 651 toward the pressure cylinder 61 and the spring 62. When the slider 63 abuts the trigger, an engaging recess 631 and the flange 632 will be slightly inclined, as FIG. 9 shows.

The noise reduction block 30 of the trigger is wrapped around the elongate board 22 from the end of the elongate board 22 to the perpendicularly bent part of the elongate board 22 by injection molding. When the trigger of the present invention is mounted on a glass sliding door 50, the noise reduction block 30 is capable of absorbing the vibration from the collision of the elongate board 22 and the slider 63, which reduces the vibration transmitted to the glass sliding door 50 and noise of the vibration.

With reference of FIG. 1, FIG. 7, FIG. 8 and FIG. 10, when the sliding speed of the sliding door 50 is too fast and forces the flange 632 of the slider 63 to slide through the noise reduction block 30 of the elongate board 22, the elongate board 22 is capable of deforming easily because of the open slot 21, which is formed around the elongate board 22 and increases the deformation space of the elongate board 22. Furthermore, the elongate board 22 extends over the end of the upper board 10, which means there is an extra space above the elongate board 22. Also, the slightly inclined angle of the engaging recess 631 and the flange 632 increases the chances for the elongate board 22 to deform upwardly after excessive impact.

Figure 11:
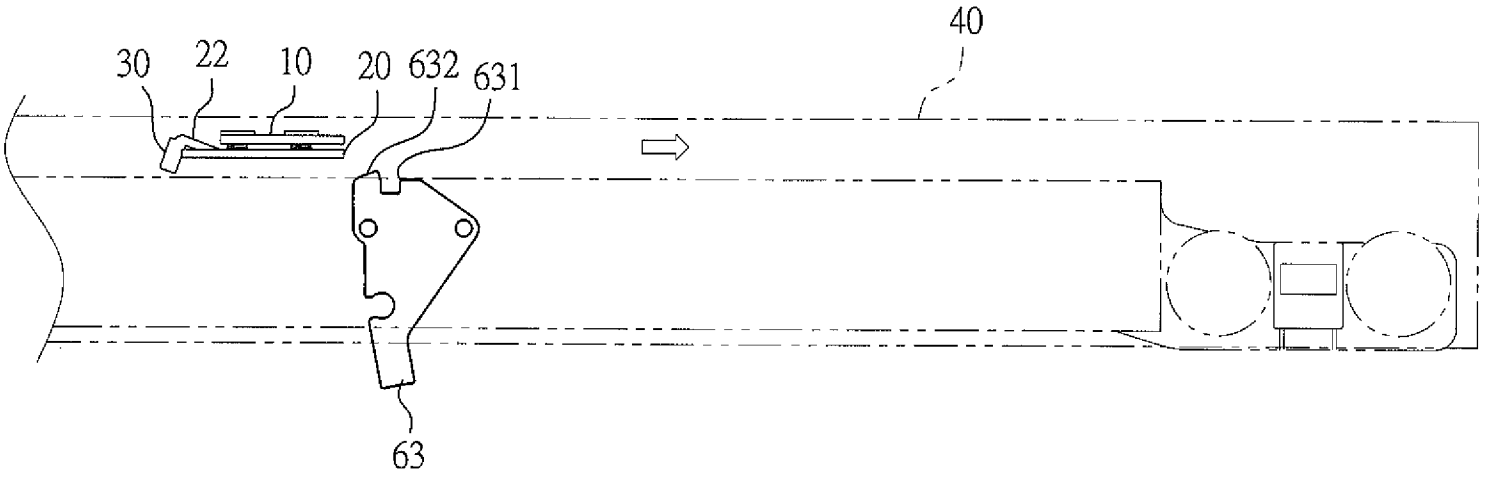
FIG. 11 is a partially enlarged front view when the slider moves through the trigger of the present invention.

Therefore, even though the sliding speed of the sliding door is too fast and forces the trigger into the location between the two sliders 63 of the soft close 60, as FIG. 11 shows, the upturned elongate board 22 is incapable of engaging with the flanges 632 of the two sliders 63. That is, the noise reduction block 30 will not be stuck between the two flanges 632 of the two sliders 63, preventing the sliding door from being restricted by the trigger and being incapable of sliding. Meanwhile, after the impact with the trigger, the sliding door 50 can still slide and move normally as usual. Besides, because the upper board 10 and the lower board 20 contain elastic material, the upper board 10 and the lower board 20 quickly recover to the normal shape, protecting the structures of the pressure cylinder, the sliders and the soft close buffer.

Figure 7:
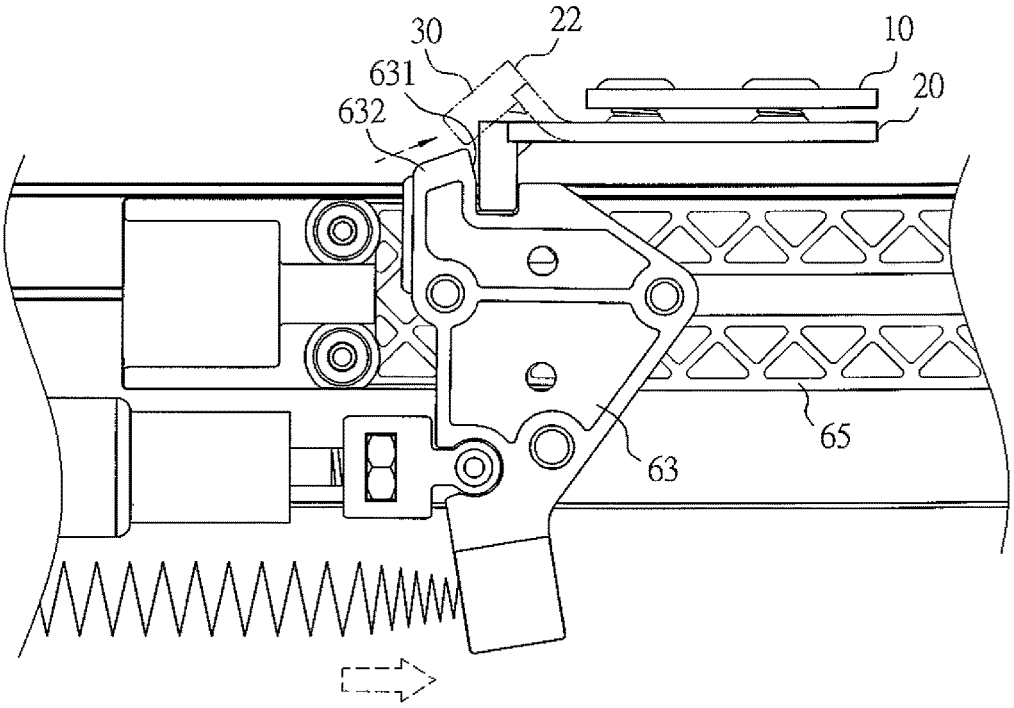
FIG. 7 is an enlarged front view of the deformed trigger and the soft close buffer.
Figure 8:
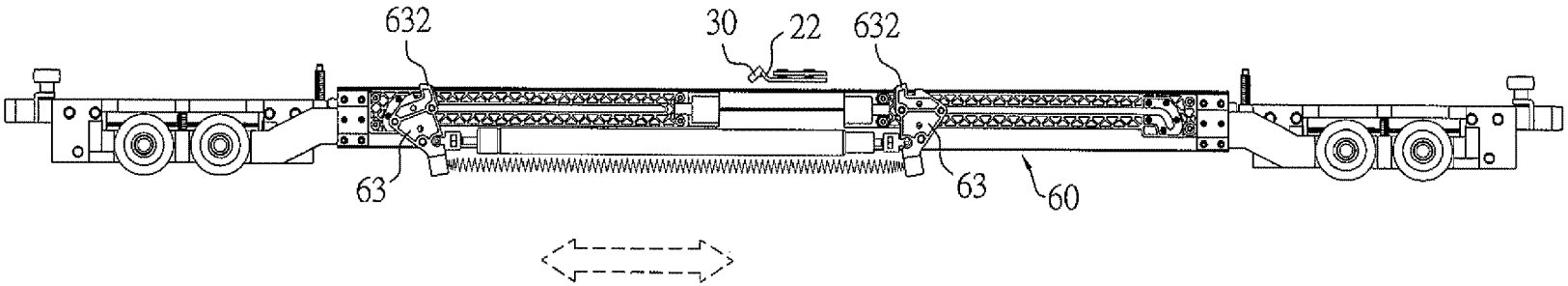
FIG. 8 is a front view showing the relative positions between the deformed trigger and the soft close buffer.
Figure 12:
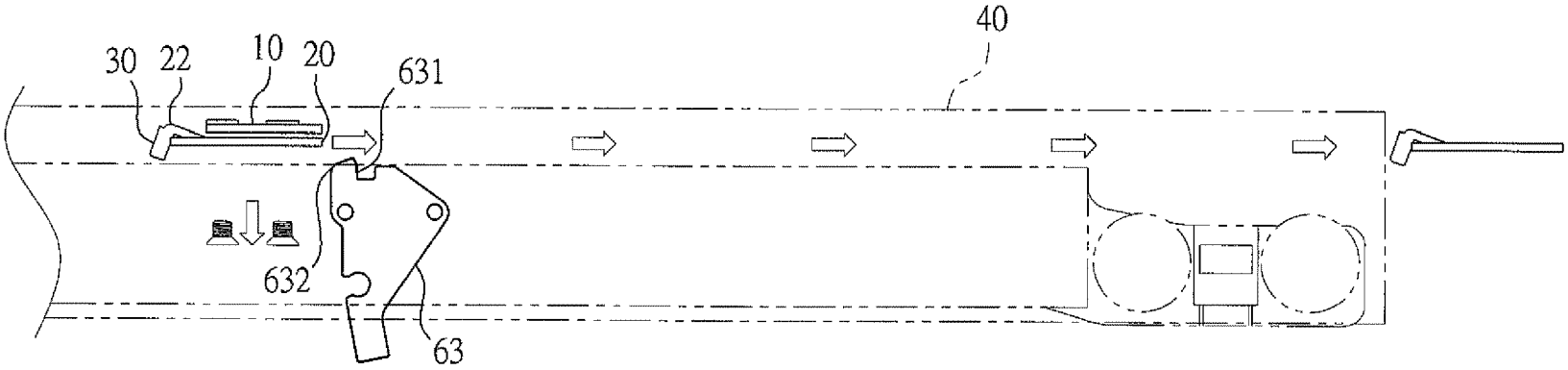
FIG. 12 is a partially enlarged front view of the trigger replacing process of the prior art.
Figure 13:
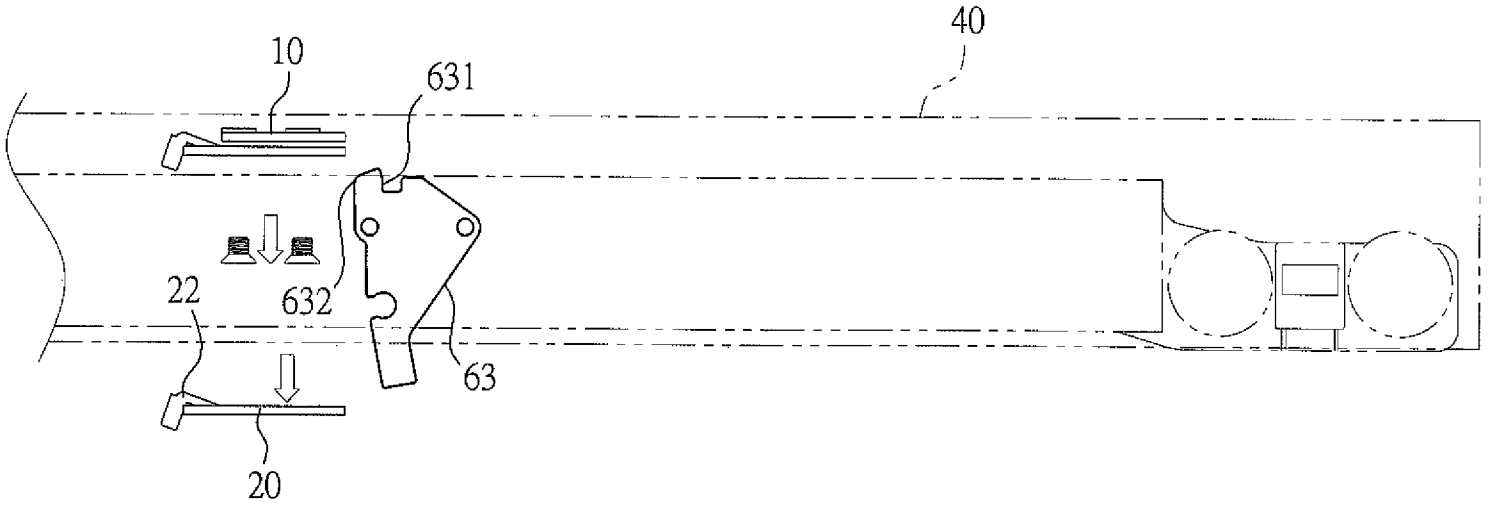
FIG. 13 is a partially enlarged front view of the trigger replacing process of the present invention.
Figure 14:
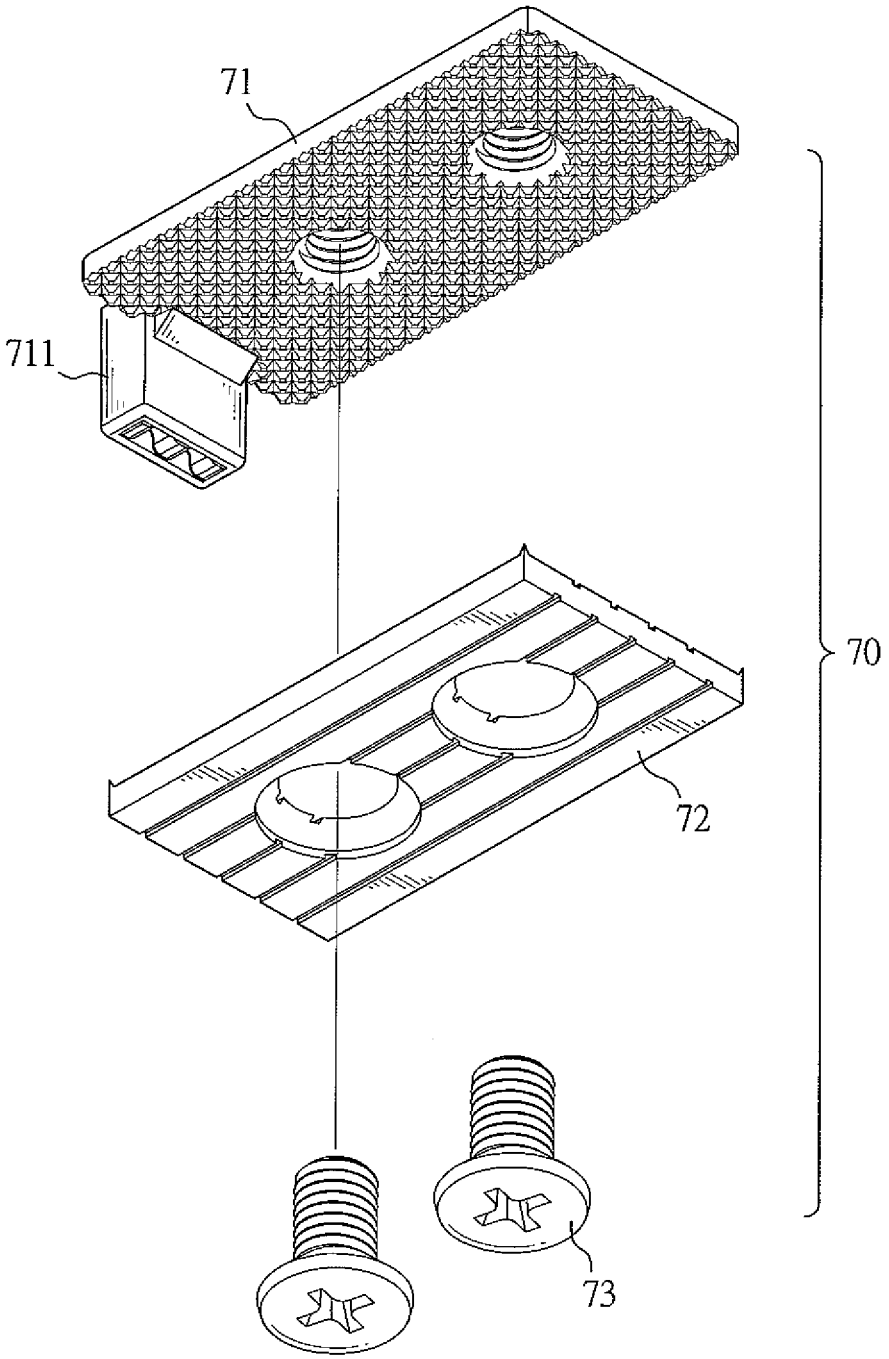
FIG. 14 PRIOR ART
FIG. 14 is a perspective view of the trigger of the prior art.
Figure 15:
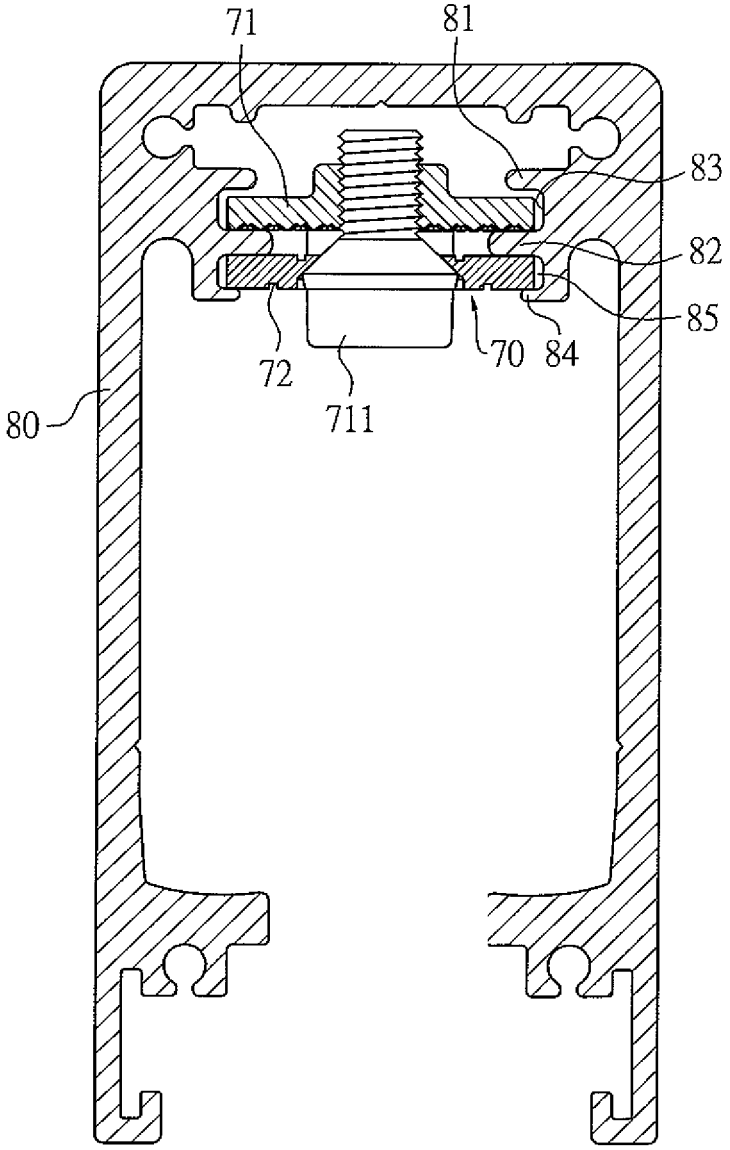
FIG. 15 PRIOR ART
FIG. 15 is the trigger in FIG. 14, shown installed in a door track unit.
Figure 16:
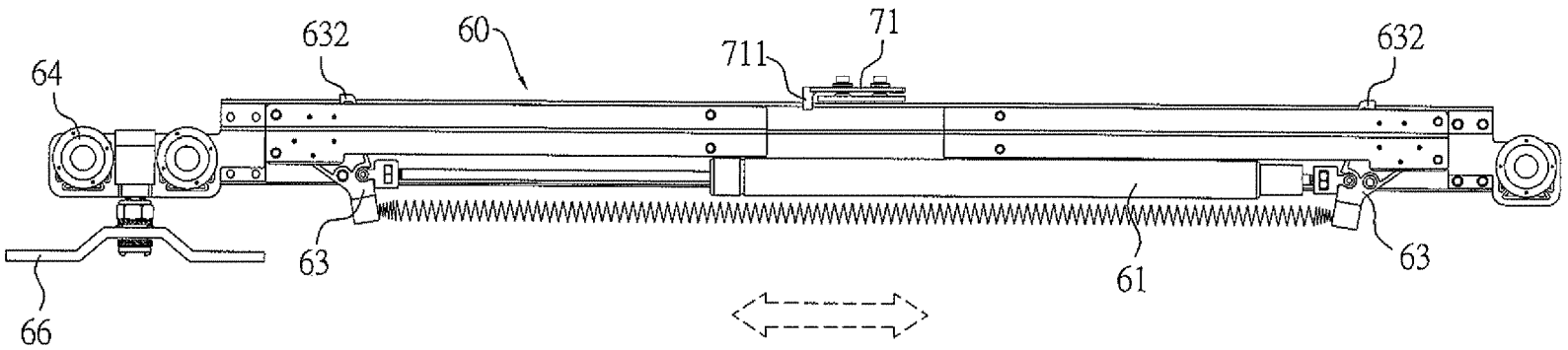
FIG. 16 PRIOR ART
FIG. 16 is a front view of the trigger in FIG. 14 with the soft close buffer.

Moreover, because there are only two ribs 411 formed on the two installation boards 41 of the door track 40 of the door track unit, and also because of the forming of the installation space 42, as FIG. 2, FIG. 4 and FIG. 7 show, when the elongate board 22 is deformed and required to be replaced, the user can directly replace the lower board 20 from the upper board 10 through the bottom opening of the door track 40, as FIG. 13 shows, rather than pull the whole trigger out of the door track 40 from one of the ends of the door track 40, as FIG. 12 shows. During this process, the present invention is more convenient and time-saving regarding the replacement of the trigger.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A trigger comprising:
an upper board being an elongate block;
a lower board being an elongate block, detachably mounted on the upper board, and having:
an open slot formed in an end of the lower board in a longitudinal direction of the lower board;
an elongate board formed on a middle of the open slot and extending to the end of the lower board, wherein a free end of the elongate board is bent downwardly and perpendicularly to the elongate board;
wherein at the end of the lower board where the open slot and the elongate board are formed, the open slot and the elongate board both horizontally extend over an end of the upper board.

2. The trigger as claimed in claim 1 further comprising:
a noise reduction block wrapped around the elongate board from the free end of the elongate board to a perpendicularly bent part of the elongate board, by injection molding.

3. The trigger as claimed in claim 2, wherein
the upper board has at least one connecting hole formed through the upper board;
the lower board contains elastic materials and has
at least one through hole formed through the lower board;
at least one connecting element mounted through the at least one through hole and mounted in the at least one connecting hole.

4. The trigger as claimed in claim 1, wherein
the upper board has at least one connecting hole formed through the upper board;
the lower board contains elastic materials and has
at least one through hole formed through the lower board;
at least one connecting element mounted through the at least one through hole and mounted in the at least one connecting hole.

5. A door track unit comprising:
the trigger as claimed in claim 4;
a door track, being elongate and hollow and having
a bottom opening formed in a bottom surface of the door track and extending in a longitudinal direction of the trigger;
two installation boards formed on and protruding from an inner surface of a top wall of the door track toward the bottom opening, wherein the two installation boards are disposed apart from each other;
two ribs each respectively formed on two side surfaces of the two installation boards; wherein the two ribs extend toward each other;
wherein the upper board of the trigger is mounted on two top surfaces of the two ribs of the two installation boards, and the lower board is mounted under two bottom surfaces of the two ribs of the two installation boards.

6. The door track unit as claimed in claim 5 further comprising:
a limiting rib formed on an inner surface of one of the two installation boards and extending toward the other installation board.

7. The door track unit as claimed in claim 5 further comprising:
an installation space formed under the lower board of the trigger, wherein a width of the installation space is greater than a width of the lower board.

8. A door track unit comprising:
the trigger as claimed in claim 1;
a door track, being elongate and hollow and having
a bottom opening formed in a bottom surface of the door track and extending in a longitudinal direction of the trigger;
two installation boards formed on and protruding from an inner surface of a top wall of the door track toward the bottom opening, wherein the two installation boards are disposed apart from each other;
two ribs each respectively formed on two side surfaces of the two installation boards; wherein the two ribs extend toward each other;
wherein the upper board of the trigger is mounted on two top surfaces of the two ribs of the two installation boards, and the lower board is mounted under two bottom surfaces of the two ribs of the two installation boards.

9. The door track unit as claimed in claim 8 further comprising:

a limiting rib formed on an inner surface of one of the two installation boards and extending toward the other installation board.

10. The door track unit as claimed in claim 8 further comprising:

an installation space formed under the lower board of the trigger, wherein a width of the installation space is greater than a width of the lower board.

* * * * *